US006761029B2

(12) United States Patent
Linerode

(10) Patent No.: US 6,761,029 B2
(45) Date of Patent: Jul. 13, 2004

(54) SWING CONTROL ALGORITHM FOR HYDRAULIC CIRCUIT

(75) Inventor: James D. Linerode, Bolingbrook, IL (US)

(73) Assignees: Caterpillar Inc, Peoria, IL (US); Shin Caterpillar Mitsubishi Ltd (JP)

( * ) Notice: Subject to any disclaimer, the term of this patent is extended or adjusted under 35 U.S.C. 154(b) by 157 days.

(21) Appl. No.: 10/013,403

(22) Filed: Dec. 13, 2001

(65) Prior Publication Data

US 2003/0110934 A1 Jun. 19, 2003

(51) Int. Cl.[7] ..... F15B 13/049
(52) U.S. Cl. ..... 60/459
(58) Field of Search ..... 91/433; 60/459

(56) References Cited

U.S. PATENT DOCUMENTS

| | | | | |
|---|---|---|---|---|
| 4,700,610 A | | 10/1987 | Bauer et al. | |
| 4,765,225 A | | 8/1988 | Birchard | |
| 5,046,312 A | * | 9/1991 | Tsuda et al. | 91/429 |
| 5,125,322 A | | 6/1992 | Hugdahl | |
| 5,138,838 A | | 8/1992 | Crosser | |
| 5,218,820 A | * | 6/1993 | Sepehri et al. | 91/433 |
| 5,261,314 A | | 11/1993 | Kimura | |
| 5,305,681 A | * | 4/1994 | Devier et al. | 91/361 |
| 5,522,301 A | | 6/1996 | Roth et al. | |
| 5,575,149 A | | 11/1996 | Stoychoff | |
| 5,876,041 A | | 3/1999 | Kuckelsberg et al. | |
| 5,960,695 A | | 10/1999 | Aardema et al. | |
| 6,131,391 A | * | 10/2000 | Poorman | 60/452 |
| 6,408,622 B1 | * | 6/2002 | Tsuruga et al. | 60/422 |

* cited by examiner

*Primary Examiner*—Edward K. Look
*Assistant Examiner*—Igor Kershteyn
(74) *Attorney, Agent, or Firm*—Finnegan, Henderson, Farabow, Garrett & Dunner; Steve M Hanley

(57) ABSTRACT

A fluid control system may comprise a pump, a tank, and an actuator including a working chamber. The system may be operative to control rotational movement of a swing structure and movement of an least one implement. A valve assembly may be configured to control fluid communication between the working chamber and the tank and to control fluid communication between the working chamber and the pump. An input device may be operative to selectively control movement of the swing structure. The system may include a controller in communication with the valve assembly and the input device. The controller may be configured to control a flow condition of the working chamber through a sensed pressure condition of the working chamber and a command from the input device.

21 Claims, 3 Drawing Sheets

SWING CONTROL ALGORITHM FOR HYDRAULIC CIRCUIT

TECHNICAL FIELD

The invention relates generally to a fluid control system and, more particularly, to a swing control algorithm for a hydraulic circuit.

BACKGROUND

Conventional hydraulic systems, for example, those implemented in large excavators, typically include an open center system to control swinging movement of an arm attached to a cab, for example. Such a system is commonly referred to as a swing circuit. In contrast, a closed center system is typically used to control implements. In such hydraulic systems, the open center system and the closed center system each include a dedicated pump; a fixed displacement pump for the open center system and a variable displacement pump for the closed center system. The open center system provides the operator with a feel for how much of a load is on the swing circuit motor, whereas the closed center system does not. However, the open center system is generally less efficient than a closed center system because some fluid flow in the open center system usually gets to tank without performing any work.

One typical hydraulic swing circuit, as shown in U.S. Pat. No. 5,575,149, includes an open center system with a fixed displacement pump. This swing circuit employs a control valve, a pair of pilot operated, dual level pressure relief valves, and a pair of pilot operated counter balance valves. The circuit does not provide a mechanism for assisting with determination of when the arm controlled by the swing circuit runs up against a wall. In addition, such a complex system that lacks the efficiency of a closed center system may not be desirable.

A fluid control system and swing control algorithm for effectively and efficiently providing an open center feel to a closed center hydraulic system is desired. The present invention is directed to solving one or more of the problems set forth above.

SUMMARY OF THE INVENTION

According to one aspect of the invention, a fluid control system operative to control rotational movement of a swing structure and movement of at least one implement may comprise a pump, a tank, and an actuator including a working chamber. A valve assembly may be configured to control fluid communication between the working chamber and the tank and to control fluid communication between the working chamber and the pump. An input device may be operative to selectively control movement of the swing structure. The system may include a controller in communication with the valve assembly and the input device. The controller may be configured to control a flow condition of the working chamber through a sensed pressure condition of the working chamber and a command from the input device.

According to another aspect of the invention, a method is provided for controlling a hydraulic system. The method may include receiving an input command from an input device, generating a desired pressure value based on the input command, generating a flow limit based on the input command, and causing incremental movement of an actuator. A magnitude of the movement over a predetermined time interval may be based on the desired pressure value and the flow limit.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention. In the drawings.

DETAILED DESCRIPTION

Reference will now be made in detail to embodiments of the invention, examples of which are illustrated in the accompanying drawings. Wherever possible, the same reference numbers will be used throughout the drawings to refer to the same or like parts.

Figure 1:
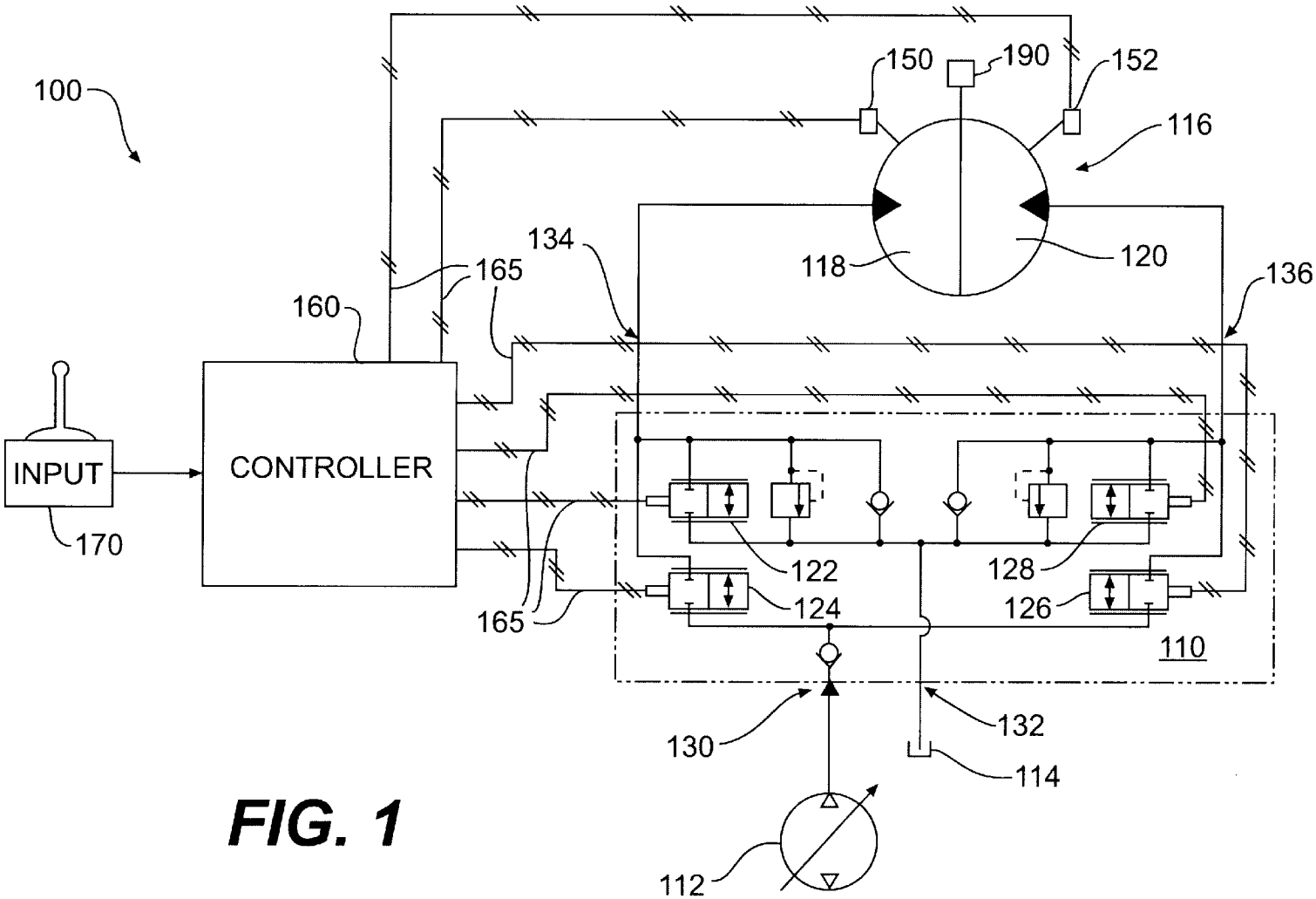
FIG. 1 is a schematic illustration of a hydraulic circuit in accordance with one embodiment of the present invention.

Referring to FIG. 1, a fluid control system, for example, hydraulic circuit 100, includes a valve assembly, for example, an independent metering valve arrangement 110, a pump 112, a tank 114, and an actuator, for example, a hydraulic motor 116. In this exemplary embodiment, the hydraulic motor may be a reversible, equal-displacement motor, having a first end chamber 118 and a second end chamber 120. The pump 112 may comprise, for example, a variable-displacement, high pressure pump.

The independent metering valve arrangement 110 includes a plurality of independently-operated, electronically-controlled metering valves 122, 124, 126, 128. The metering valves 122, 124, 126, 128 control fluid flow between the pump 112, the tank 114, and the hydraulic motor 116. The metering valves may be spool valves, poppet valves, or any other conventional type of metering valve that would be appropriate. The metering valves are referred to individually as a chamber-to-tank first end (CTFE) metering valve 122, a pump-to-chamber first end (PCFE) metering valve 124, a pump-to-chamber second end (PCSE) metering valve 126, and a chamber-to-tank second end (CTSE) metering valve 128. The independent metering valve arrangement 110 also includes an input port 130, an output port 132, a first end control port 134, and a second end control port 136.

The hydraulic control system 100 also includes a first end pressure sensor 150, a second end pressure sensor 152, a controller 160, and an operator input device 170. The first and second end pressure sensors 150,152 are configured to communicate with the controller 160. The input device 170 also communicates with the controller and allows an operator to control the hydraulic circuit 100. For example, the input device 170 allows the operator to swing a load, for example, a pivotal operator cab with a work arm and/or a work implement 190. Alternatively, the input device 170 may represent a source of input commands from, for example, a computer used to automatically control the hydraulic motor 116 without an operator.

As shown in FIG. 1, the controller 160 communicates electronically with the input device 170, the metering valves 122, 124, 126, 128, and the pressure sensors 150, 152. The controller 160 may receive information from the input device 170, for example, a swing direction command, as well as from the pressure sensors 150, 152. Based on the commands from the input device 170 and the pressure sensors 150, 152, the controller may determine a desired operation for the hydraulic circuit 100 and an appropriate set of outputs 165 to the metering valves 122, 124, 126, 128. In one embodiment, the outputs 165 may represent currents to each of the metering valves 122, 124, 126, 128.

Figure 2:
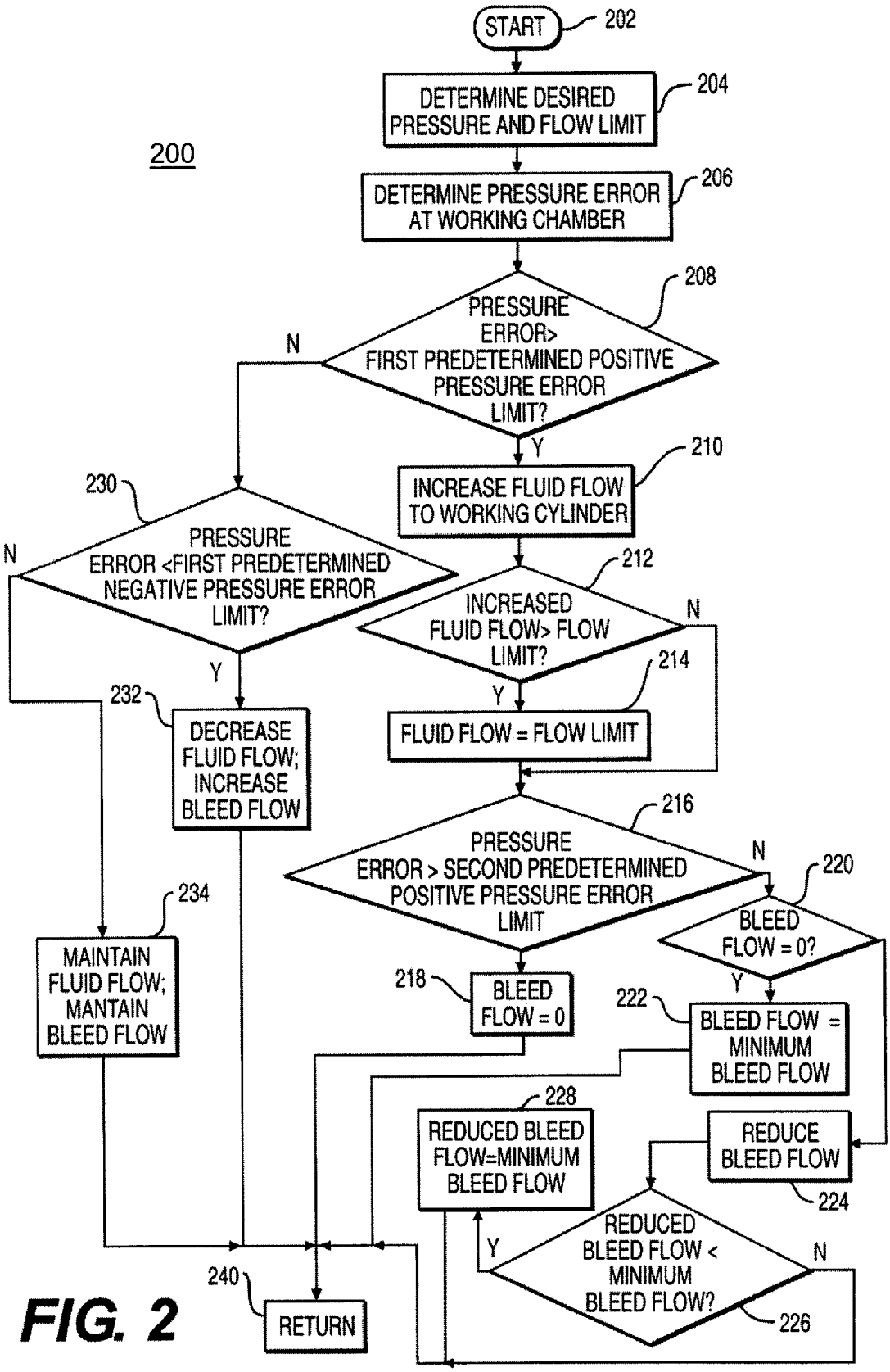
FIG. 2 is a block diagram in accordance with one embodiment of the present invention.

FIG. 2 is an exemplary operation 200 of the controller 160 in accordance with a first exemplary embodiment of the hydraulic circuit 100. It should be appreciated that the numerical pressure error limits and ranges used throughout this exemplary operation 200 may differ depending on the machinery employing an algorithm according to the invention.

Referring to FIG. 2, control commences with step 202 when the controller 160 receives a command from the input device 170. In step 204, the controller 160 determines a desired pressure to be applied to a working chamber and a flow limit of fluid to the working chamber, for example, by extrapolation from the graphs shown in FIGS. 3 and 4. For example, a forward push on the input device 170, for example, an operating lever, may be associated with the positive lever positions of FIGS. 3 and 4 and may cause the application of pressurized fluid to the first end chamber 118 of the hydraulic motor 116 to rotate the motor 116 in a clockwise direction. In this situation, the first end chamber 118 would be the working chamber. It should be appreciated that the opposite may be true for a rearward pull on the input device 170. Further, it should be appreciated that the effect of the directional movement of the input device 170 may be reversed as may be the association of the lever positions of FIGS. 3 and 4.

Control then continues to step 206 where the controller 160 determines the pressure error at the working chamber, i.e., first end chamber 118 or second end chamber 120. The pressure error may be determined by subtracting the pressure sensed by the corresponding pressure sensor 150, 152 at the working chamber from the desired pressure determined by the position of the input device 170.

Then, in step 208, the controller 160 determines whether the pressure error is greater than a first predetermined positive pressure error limit of, for example, 50 KPa (7.252 psi). If the pressure error is greater than 50 KPa, control proceeds to step 210. Otherwise, control skips to step 230.

In step 210, the controller 160 increases the fluid flow to the working chamber. The fluid flow to the working chamber may be controlled by operating the pump-to-chamber metering valve 124, 126 associated with the working chamber. For example, if the first end chamber 118 is the working chamber, the PCFE metering valve 124 is controllably opened to increase the fluid flow to the first end chamber 118. The amount that the pump-to-chamber metering valve 124, 126 associated with the working chamber is opened may be determined by a predetermined algorithm or look-up table. Gradual ramping of the fluid flow to the working chamber may provide a more controlled and/or smoother movement of the load. The ramping may be a linear or non-linear function.

In addition, the chamber-to-tank metering valve associated with the non-working chamber may meter flow out of the non-working chamber as the pump-to-chamber metering valve associated with the working chamber controls fluid flow to the working chamber. Metering of the chamber-to-tank valve associated with the non-working chamber may provide extra resistance to the working chamber and facilitate a quicker pressure buildup of fluid pressure at the working chamber.

Then, in step 212, the controller 160 determines whether the increased fluid flow to the working chamber is greater than the flow limit determined by the position of the input device 170. If the increased fluid flow is greater than the flow limit, control continues to step 214. Otherwise, control skips to step 216.

In step 214, the controller 160 sets the increased fluid flow equal to the flow limit determined by the position of the input device 170. Control continues to step 216.

In step 216, the controller 160 determines whether the pressure error is greater than a second predetermined positive pressure error limit of, for example, 5000 KPa (725.189 psi). If the pressure error is greater than 5000 KPa, control continues to step 218. Otherwise, control goes to step 220.

In step 218, the controller 160 sets the bleed flow associated with the working chamber equal to zero. The bleed flow may be controlled by the chamber-to-tank metering valve 122, 128 associated with the working chamber. For example, if the first end chamber 118 is the working chamber, the bleed flow may be controlled by the CTFE metering valve 122. In step 218, the controller 160 may close the appropriate chamber-to-tank metering valve to achieve zero bleed flow. Control then continues to step 240, where control is returned to step 202.

In step 220, when the controller 160 determines that the pressure error is not greater than 5000 KPa in step 216, the controller 160 determines whether the bleed flow is equal to zero. If the bleed flow equals zero, control continues to step 222. Otherwise, control goes to step 224.

In step 222, the controller 160 sets the bleed flow equal to a minimum bleed flow. The minimum bleed flow may be any predetermined amount, for example, 3 liters/min (lpm), 5 lpm, 10 lpm, etc. The minimum bleed flow may differ depending on the machinery employing an algorithm according to the invention. Control then continues to step 240, where control is returned to step 202.

In step 224, when the controller 160 determines that the bleed flow is not equal to zero in step 220, the controller reduces the amount of bleed flow. Then, in step 226, the controller 160 determines whether the reduced bleed flow is less than the minimum bleed flow. If the reduced bleed flow is less than the minimum bleed flow, control continues to step 228. Otherwise, control skips to step 240, where control is returned to step 202.

In step 228, when the controller 160 determines that the reduced bleed flow is less than the minimum bleed flow, the controller 160 sets the reduced bleed flow equal to the minimum bleed flow. Control then continues to step 240, where control is returned to step 202.

In step 230, after determining that the pressure error is not greater than 50 KPa in step 208, the controller 160 determines whether the pressure error is less than a first predetermined negative pressure error limit of, for example, −50 KPa (−7.252 psi). If the pressure error is less than −50 KPa, control continues to step 232. Otherwise, control goes to step 234.

In step 232, the controller 160 decreases the fluid flow to the working chamber and increases the bleed flow. Control then continues to step 240, where control is returned to step 202.

In step 234, after determining that the pressure error is not less than −50 KPa, the controller maintains the present fluid flow to the working chamber and the present bleed flow. Control then continues to step 240, where control is returned to step 202.

Figure 3:
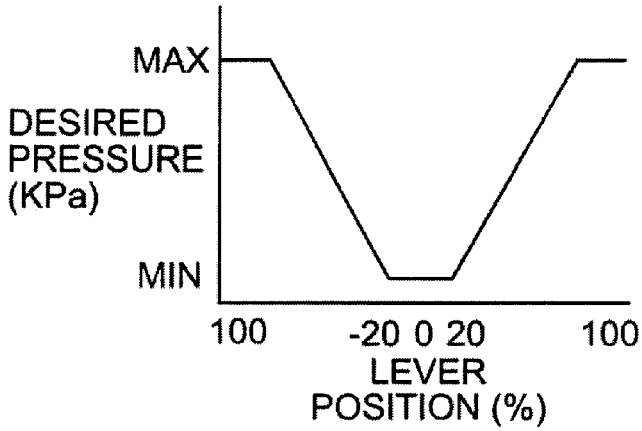
FIG. 3 is a graph of desired pressure versus lever position in accordance with one embodiment of the present invention.
Figure 4:
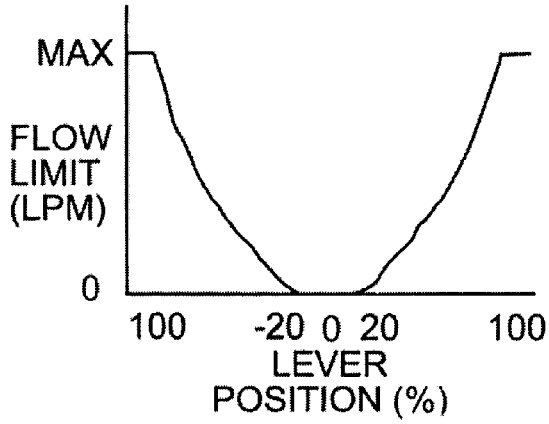
FIG. 4 is a graph of flow limit versus lever position in accordance with one embodiment of the present invention.

Referring to FIGS. 3 and 4, the maximum and minimum desired pressures and the maximum flow limit may differ depending on the machinery employing an algorithm according to the invention. In addition, the relationship between desired pressure and lever position may be nonlinear. Furthermore, the relationship between flow limit and lever position may be linear or another nonlinear configuration.

INDUSTRIAL APPLICABILITY

In use, the metering valves 122, 128 control chamber-to-tank fluid flow while the metering valves 124, 126 control pump-to-chamber fluid flow. Conventional rotation of the motor 116 in one direction may be achieved, for example, by selective, operator-controlled actuation of the metering valves 124, 128 and rotation in a second, opposite direction may be achieved, for example, by simultaneous operator controlled actuation of the metering valves 122, 126.

Referring to FIG. 1, the input device 170 may be positioned to provide an input to initiate the exemplary control operation shown in FIG. 2. The input may include a desired pressure at the working chamber and a flow limit to the working chamber based on the lever position in accordance with the exemplary graphs shown in FIGS. 3 and 4.

For example, an operator may initially move the input device 170 to a 100% position corresponding to clockwise rotation of the motor 116 to position a cab with an attached swing arm. Accordingly, the desired working pressure to be applied to a working chamber may be equal to a maximum desired pressure and the flow limit may be equal to a maximum flow limit.

As the exemplary operation 200 proceeds, the maximum desired pressure is compared to the sensed pressure at the working chamber, for example, first end chamber 118, associated with clockwise rotation. Since the pressure error will likely be greater than, for example, 5000 KPa, or some other second predetermined positive pressure limit, the controller 160 may operate the PCFE metering valve 124 to increase the fluid flow to the first end chamber 118 up to the maximum flow limit associated with the position of the input device 170. The controller 160 may also operate the CTFE metering valve 122 to provide zero bleed flow. This operation may continue until the position of the input device 170 is changed or until the pressure error is less than 5000 KPa.

If the load is swinging freely, i.e., without resistance of a wall, barrier, or the like, the pressure error may eventually be less than 5000 KPa. However, when swinging freely, it is unlikely that the pressure error will be less than the first predetermined positive pressure limit, for example, 50 KPa, or some other first predetermined positive pressure limit, even though the operator maintains the input device 170 in the 100% clockwise position. When the pressure error is between the first and second predetermined positive pressure limits, the controller 160 may continue to increase the fluid flow to the first end chamber 118 up to the maximum flow limit associated with the position of the input device 170. The controller 160 may operate the CTFE metering valve 122 to decrease the bleed flow to or maintain a bleed flow at a minimum bleed flow equal to a predetermined value. This operation may continue until the position of the input device 170 is changed or until the pressure error is less than 50 KPa or greater than 5000 KPa. Again, the specific pressures identified are exemplary only. The present invention is not limited to operation in accordance with specific pressures.

If the load continues to swing freely, it is likely that the pressure error will drop below the second predetermined positive pressure error limit, for example, 5000 KPa, while overcoming friction forces encountered to get the load swinging. After overcoming the friction forces, the pressure error will likely increase and become greater than the second positive limit, for example, 5000 KPa. After exceeding the second positive limit, the controller 160 may operate the PCFE metering valve 124 to increase the fluid flow to the first end chamber 118 once again, up to the maximum flow limit associated with the position of the input device 170. The controller 160 may also operate the CTFE metering valve 122 to provide zero bleed flow. This situation may continue until the position of the input device 170 is changed or until the pressure error is less than 5000 KPa.

If, after initiating movement, the load encounters an obstruction, for example, a wall or any other barrier, the pressure error may decrease below the first predetermined positive pressure error limit, for example, 50 KPa. Until that time, the system 100 may operate as described above for the situation where the pressure error is greater than the second positive limit and the situation where the pressure error is between the first and second positive limits.

When the pressure error becomes less than the first predetermined positive pressure error limit, for example, 50 KPa, and greater than a first predetermined negative pressure error limit, for example, −50 KPa, the controller 160 may operate the PCFE metering valve 124 to maintain the present fluid flow to the first end chamber 118 up to the maximum flow limit associated with the position of the input device 170. The controller 160 may also operate the CTFE metering valve 122 to maintain the previous bleed flow. These controller operations may keep the pressure error near zero. This situation may continue until the position of the input device 170 is changed or until the pressure error is greater than 50 KPa or less than −50 KPa.

If the pressure error becomes less than the first predetermined negative pressure error limit, for example, −50 KPa, the controller 160 may operate the PCFE metering valve 124 to decrease the present fluid flow to the first end chamber 118. The controller 160 may also operate the CTFE metering valve 122 to increase the bleed flow. These controller operations may force the pressure error back toward zero. This situation may continue until the position of the input device 170 is changed or until the pressure error is greater than −50 KPa.

It should be appreciated that the bleed flow may provide damping and stability to the system. However, upon initiation by the operator, the chamber-to-tank metering valve 122, 128 associated with the working chamber 118, 120, which controls the bleed flow, may remain closed to eliminate the possibility of the load swinging in the opposite direction, also referred to as backdriving. It should also be appreciated that, at a full lever command, the pressure error may be large and the bleed flow may be reduced to zero, thereby improving fuel efficiency.

Thus, the present invention provides a swing control algorithm for a hydraulic circuit, which may provide both flow and pressure control on a closed center system without the use of a dedicated swing pump. The swing control algorithm may simplify the hydraulic control system, offer a cost savings, and/or provide an open center feel to a closed center hydraulic system.

As shown in FIG. 1, the operation of an exemplary embodiment of this invention may be implemented on a controller 160. The controller 160 may include a general purpose or special purpose computer, a programmed microprocessor or microcontroller and peripheral integrated circuit elements, an ASIC or other integrated circuit, a hardware electronic or logic circuit such as a discrete element circuit, a programmable logic device such as a PLD, PLA, FPGA or PAL, or the like. In general, any device on which a finite state machine capable of implementing the flowchart shown in FIG. 2 can be used to implement the controller functions of this invention.

It will be apparent to those skilled in the art that various modifications and variations can be made in the hydraulic control system and/or the swing control algorithm without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A fluid control system operative to control rotational movement of a swing structure and movement of at least one implement, the fluid control system comprising:

a pump;

a tank;

an actuator including a working chamber;

a valve assembly configured to control fluid communication between the working chamber and the tank and to control fluid communication between the working chamber and the pump;

an input device operative to selectively control movement of the swing structure; and a controller in communication with the valve assembly and the input device, the controller being configured to control a flow condition of the working chamber through a sensed pressure condition of the working chamber and a command from the input device corresponding with a desired pressure of the working chamber.

2. The system of claim 1, wherein the actuator includes a motor.

3. The system of claim 2, wherein the motor includes a reversible motor configured to swing a load.

4. The system of claim 1, wherein the input device includes an operating lever configured such that a position of the lever corresponds with a predetermined desired pressure of the working chamber.

5. The system of claim 4, wherein the position of the lever corresponds with a predetermined flow limit of fluid to the working chamber.

6. The system of claim 1, wherein the controller is configured to compare a pressure difference between the sensed pressure condition and a desired pressure of the working chamber to a first predetermined positive pressure error limit, a second predetermined positive pressure error limit, and a first predetermined negative pressure error limit, the second positive limit being greater than the first positive limit.

7. The system of claim 6, wherein, when the pressure difference is greater than the second positive limit, the controller is configured to increase fluid flow to the working chamber and to provide zero bleed flow, the increased fluid flow not exceeding a predetermined flow limit.

8. The system of claim 6, wherein, when the pressure difference is less than the second positive limit and greater than the first positive limit, the controller is configured to increase fluid flow to the working chamber and to provide at least a minimum bleed flow, the increased fluid flow not exceeding a predetermined flow limit.

9. The system of claim 6, wherein, when the pressure difference is less than the first negative limit, the controller is configured to decrease fluid flow to the working chamber and to increase bleed flow.

10. The system of claim 6, wherein, when the pressure difference is less than the first positive limit and greater than the first negative limit, the controller is configured to maintain fluid flow to the working chamber and to maintain bleed flow.

11. The system of claim 6, wherein the first positive limit is equal to an absolute value of the first negative limit.

12. A method for controlling a hydraulic system, comprising:

receiving an input command from an input device;

generating a desired pressure value based on the input command;

generating a flow limit based on the input command; and causing incremental movement of an actuator, a magnitude of the movement over a predetermined time interval being based on the desired pressure value and the flow limit.

13. The method of claim 12, further including reversibly swinging a load.

14. The method of claim 12, further including positioning an operating lever to generate the input command, the lever being configured such that a position of the lever corresponds with the desired pressure value of a working chamber of the actuator.

15. The method of claim 14, wherein the position of the lever corresponds with the flow limit of fluid to the working chamber.

16. The method of claim 12, further including sensing pressure of a working chamber of the actuator, wherein the magnitude of the movement of the actuator is based on a difference between the desired pressure value and the sensed pressure.

17. The method of claim 16, further including comparing the pressure difference to a first predetermined positive pressure error limit, a second predetermined positive pressure error limit, and a first predetermined negative pressure error limit, the second positive limit being greater than the first positive limit, and the first positive limit being equal to an absolute value of the first negative limit.

18. The method of claim 17, wherein said controlling operation includes, when the pressure difference is greater than the second positive limit, increasing fluid flow to the working chamber and providing zero bleed flow, the increased fluid flow not exceeding a predetermined flow limit.

19. The method of claim 17, wherein said controlling operation includes, when the pressure difference is less than the second positive limit and greater than the first positive limit, increasing fluid flow to the working chamber and providing at least a minimum bleed flow, the increased fluid flow not exceeding a predetermined flow limit.

20. The method of claim 17, wherein said controlling operation includes, when the pressure difference is less than the first negative limit, decreasing fluid flow to the working chamber and increasing bleed flow.

21. The method of claim 17, wherein said controlling operation includes, when the pressure difference is less than the first positive limit and greater than the first negative limit, maintaining fluid flow to the working chamber and maintaining bleed flow.

* * * * *